United States Patent [19]

Jordan

[11] 4,274,835

[45] Jun. 23, 1981

[54] METHOD AND COMPOSITION FOR MODIFYING BURNING OF SULFUR IN COALS AND HYDROCARBON FUELS

[75] Inventor: Frederick L. Jordan, Santa Ana, Calif.

[73] Assignee: Oryx, Inc., Santa Ana, Calif.

[21] Appl. No.: 91,065

[22] Filed: Nov. 5, 1979

[51] Int. Cl.[3] ..... C10L 9/10; C10L 1/10

[52] U.S. Cl. ..... 44/1 SR; 44/4; 44/50; 44/68; 585/14

[58] Field of Search ..... 44/18, 22, 68, 1 SR, 44/4, 50; 585/14

[56] References Cited

U.S. PATENT DOCUMENTS

| | | | |
|---|---|---|---|
| 2,445,778 | 7/1948 | Hale | 44/68 X |
| 3,640,691 | 2/1972 | Ilnyckyj et al. | 44/62 |

FOREIGN PATENT DOCUMENTS

| | | | |
|---|---|---|---|
| 14213 | of 1904 | United Kingdom | 44/18 |

OTHER PUBLICATIONS

The Condensed Chemical Dictionary–Eight Edition–Van Nostrand Reinhold Co. N.Y. (1971) pp. 173, 174, 206, 436 & 821.

*Primary Examiner*—Carl F. Dees
*Attorney, Agent, or Firm*—Knobbe, Martens, Olson, Hubbard & Bear

[57] ABSTRACT

Efficiency of internal combustion engine performance, i.e. improved mileage per gallon, and improved performance, e.g. lower exhaust temperature, is increased by the addition of carotenoids, beta-carotene in particular, to diesel fuel before use, and the combustion of coal is improved, i.e. higher BTU/lb results, sulfur in emission from such coal combustion is reduced, and sulfur in ash is increased, by the addition of squalene, squalane, carotenoids, beta-carotene in particular, hemoglobin and chlorophyll to the coal before burning.

7 Claims, No Drawings

METHOD AND COMPOSITION FOR MODIFYING BURNING OF SULFUR IN COALS AND HYDROCARBON FUELS

BACKGROUND OF THE INVENTION

Since the industrial revolution, and particularly within the last century, carbonaceous fuels, coal and liquid hydrocarbons, have become the dominant source of energy for most stationary applications and virtually all internal combustion engines. Sulfur containing emissions from the combustion of these fuels has always been a serious problem. Indeed, the use of coal as a fuel was greatly curtailed because of noxious emission gases, one of the greater offenders being sulfur compounds, e.g. sulfur dioxide, sulfur trioxide and more complicated organic and inorganic sulfur compounds. Recently, ecological and public health concerns have become more and more important in the selection of fuels and with these ecological concerns greater attention has been focused upon the role of sulfur in emission contamination of the environment and upon methods for reducing sulfur emission gases into the environment.

In addition, with the shortage of liquid hydrocarbon fuels, gasoline and diesel, and comparable products, great attention has been focused upon methods for using high sulfur containing petroleums and upon more efficient use of existing reserves of these precious hydrocarbon fuels.

Innumerable efforts have been made in the past to improve efficiency of the internal combustion engine, the efficiency of the burning process generally, and to the removal of sulfur from emission gases from these combustions. The present invention constitutes a new approach and a step function improvement over the prior art.

SUMMARY OF THE INVENTION

I have discovered that the burning characteristics of diesel fuel, as determined by performance, mileage per gallon, and exhaust temperature, is significantly improved by burning the diesel in mixture with carotenoids, e.g. beta-carotene, or chlorophyll, or mixtures of both. I have also discovered that sulfur in gaseous combustion products of coal is significantly reduced, energy output increased, and sulfur in ash increased, by burning the coal in mixture with squalane, squalene, carotenoids, hemoglobin or chlorophyll, or mixtures of the same.

DESCRIPTION OF THE PREFERRED EMBODIMENTS

The method of my invention is extremely simple to carry out. As applied to liquid hydrocarbon fuels, crude oil and diesel fuels for example, all that is necessary is to dissolve into the fuel small amounts of one or more of the active additive constituents, e.g. chlorophyll or carotenoids, mixtures of beta-carotene and chlorophyll being preferred. It has been found convenient to provide a stock solution of the active additive component and to make the additions by adding measured amounts of the stock solution. For example, the active component may be dissolved in any solvent for the component which is also soluble in the hydrocarbon fuel. Many solvents are quite suitable for this purpose, including many hydrocarbon fuels. Xylene, for example, is an ideal solvent for most of the active constituents. Toluene, benzene, and cyclic hydrocarbons and hydrocarbon liquids containing cyclic constituents, halogen substituted carbon solvents, e.g. chloroform, trichloroethylene, liquid aldehydes, alcohols and ketones and even water in small amounts are also suitable solvents.

Solutions of the active additive constituents are simply dissolved into the hydrocarbon fuel or are sprayed over or otherwise intermixed with the coal. The fuel, whether coal or hydrocarbon fuel, is simply burned in the conventional manner. Hemoglobin may be dissolved in water and sprayed over the coal. Polar solvents generally may be used effectively for hemoglobin.

Road tests on diesel powered industrial vehicles demonstrated that the addition of small amounts of the active constituent, in the range of up to about ten thousand parts per million, generally under 1000 ppm, i.e. in the parts per million range, is a dramatic increase in performance, fuel efficiency, and also brings about a reduction in exhaust temperature on the vehicle. An increase in fuel economy of 5% to 20% depending on engine type and loading has been repeatedly obtained by the addition of the active constituents in the parts per million range. Chlorophyll and beta-carotene, and mixtures of the same within a 1:10 to 10:1 mole ratio of beta-carotene to chlorophyll provide a significant improvement in fuel economy. Operators have reported better performance and lower exhaust temperatures in nearly all cases. Limited engine dynamometer tests were attempted but, it is believed, because of inadequate controls and instrumentation for accurate simulation of vehicle load and road conditions, I have been unable to consistently duplicate the road test data. The repeatability of the road test data, has, however, given me confidence that dynamometer tests which were truly duplicative of road conditions would duplicate the results of the road tests, including improved efficiency, performance and reduction in exhaust temperature. In some instances, even more dramatic improvement than the typical 5% to 20% improvement in efficiency has been achieved.

Exemplary of the data demonstrating the efficiency improvement in internal combustion engines, is a typical example in which the fuel efficiency of a working, industrial truck using a Cummins diesel engine was improved from 5.2 to 6.2 miles per gallon with a pyrometer temperature reduction of from 100° to 120° F. lower than normal operating temperatures.

In other well-controlled road tests using diesel trucks which were regularly loaded to the same, maximum load and which travelled the same route on a regular basis, mileage increased from 4.8 miles per gallon to 6.2 miles per gallon, exhaust temperatures were significantly reduced and the drivers reported better performance, i.e, a feeling of more power. The latter observation is, of course, somewhat subjective but since the drivers have been driving the same trucks for some time there is every reason to give at least qualitative weight to these observations.

In one long term test of a diesel truck under random load and operational conditions, an average base fuel efficiency of 4.29 mpg over a 90 day period was determined. Treatment with beta-carotene-chlorophyll mixtures over a like period of time increased the average fuel efficiency to 4.8 mpg, with accompanying exhaust gas temperature reduction.

It appears from all the experimental data and practical observations that the addition of these active constituents, carotenoids and chlorophyll, cause more complete combustion and recovery of heat in the cylinder during the power stroke, thus increasing power output and improving the yield in miles per gallon and, at the same time, decreasing combustion in the exhaust from the cylinder and, hence, reducing the exhaust cycle temperature significantly. A hitherto unknown and unexpected synergistic effect is certainly achieved, but the mechanism of the synergism is not known. It is postulated that the active composition acts, either alone or in combination with sulfur compounds, as a catalyst or causes the sulfur to act as a catalyst during the maximum temperature-pressure period of internal combustion. This is only a theory, as of now, however, and much work remains before a complete elucidation of the mechanism of the reaction can be explained.

There are some data which suggest that there is a precombustion effect on the sulfur distribution in hydrocarbons. It has been found, for example, that the addition of beta-carotene and chlorophyll to crude oil causes sulfur to concentrate in the higher boiling fractions of the oil, as compared with the same oil without the additive. The totallity of data presently available is fairly conclusive, however, that the major synergism between the additive and the fuel occurs primarily at or near maximum temperature-pressure internal combustion conditions.

In utilizing this method on coal, the method is demonstrated by the laboratory procedure of grinding the coal to a relatively uniform size, e.g. to a 60 sieve screen size, wetting the coal with a solution of the active constituent, e.g. squalane, squalene, carotene, chlorophyll or hemoglobin, dissolved in a suitable solvent, drying the coal and then burning it in a combustion chamber. In one example of the method, the coal is ground and weighed into a beaker. The weighed coal is covered with a solution containing the active constituent, shaken, allowed to stand for a few minutes or a few hours, or overnight, the excess solvent is removed, the coal dried and then burned. No particular technique or method for intermixing the coal with the additive constituent is particularly significant, however. The only significant factor is that the coal and the active ingredient be relatively uniformally intermixed.

Coal, treated in the manner just described, is analyzed for sulfur using standard, generally accepted methods, in particular, American Society of Testing Materials Test ANSI/ASTMD 1757-62 (reapproved in 1974) was used to determine sulfur in coal ash. ASTM Test D 3174-73 was used to determine the amount of ash in the coal. ASTM Test D 3177-75 was used to determine total sulfur in coal. Coal analyses for sulfur content, ash content and sulfur in ash were run by commercial testing laboratories on a "blind" basis: i.e. the testing laboratory was not given information as to the additive used on the coal samples provided. Also, ASTM D 2015-77 was run on these blind coal samples and verified a 4 to 5% increase in B.T.U. output of the coal that was treated and also a significant reduction in ash was found by tests run according to D 1757-62.

While there were some variability quantitatively in the data, the data on the effectiveness in sulfur reduction was consistent, and repeatedly showed a reduction in available sulfur, that is sulfur which is available and measurable upon the combustion analysis of the coal. The following data are fairly typical of data obtained on the analysis of coal treated with the various active constituents. The standard coal sample, untreated, on a dry weight basis, had 2.92% available sulfur, the same coal when treated with a solution of hemoglobin in water had only 2.58% sulfur, the same coal treated with beta-carotene in chloroform solvent had only 2.55% sulfur, the same coal treated with beta-carotene in chloroform greatly diluted with diesel, as solvents, had only 2.39% sulfur and the same coal treated with squalene had only 2.65% sulfur. Energy output, BTU/lb, was increased as a result of the additive, by 5.7% compared with untreated coal. These data were provided by an independent, commercial testing and engineering laboratory, working on blind samples, i.e. the laboratory was not advised as to the content or nature of the additive to the coal and corroborated my earlier analytical data.

It has been shown in coal combustion studies that sulfur in coal combustion products is transferred from the gaseous emissions to the solid coal ash. Coal samples, treated and untreated, were burned under controlled, identical conditions. The gaseous emissions were collected and analyzed by gas chromatography separation and mass spectroscopy determination for sulfur compounds. Gaseous emissions from untreated coal contained 0.01 percent SO and 0.2 percent $SO_2$. The same coal, treated, contained less than 0.001 percent SO and 0.03 percent $SO_2$. X-ray diffraction and scanning electron microscope studies on coal ash showed a marked increase in sulfur content of the ash from treated coal as compared with ash from untreated coal.

The potential significance of concentrating sulfur in the solid ash byproduct of coal by reduction of the sulfur content of effluent gases from coal combustion is, alone, very profound. Whole new fields of use of coal as a fuel may be opened up, industrially and geographically. It has been estimated, variously, that the United States has from several hundred to a few thousand years reserve of coal. Ecological concerns, in large part related to sulfur in combustion gases, has impeded our use of this great resource. This present invention may open the way to use these coal reserves in an ecologically acceptable manner.

Add to this the added efficiency of recovery of heat energy from coal and coal begins more and more to look like the fuel of the near future, and perhaps for several decades or even longer.

I have postulated a number of possible theories to explain this phenomena; however, I have not satisified myself that any one particular theory is a wholly satisfactory explanation for the phenomena; however, I have conducted many tests and have determined that the phenomena is real and repeatable. Without being limited to any particular explanation, and without attempting to postulate a particular chemical reaction mechanism, it is my belief that the active constituent reacts before and/or during the combustion phase, probably in early stages of combustion, with the sulfur and forms a stabile sulfur compound or group of compounds of presently unknown composition which stabilizes the sulfur and prevents it being carried off in the gaseous emissions. Much work remains to be done to ascertain the mechanism and to explain the phenomena which has been observed and repeatedly established by my work. For example, my data to the present time are insufficient to explain where the sulfur resides in the combustion of coal and exactly what the source of efficiency is in the internal combustion engine.

INDUSTRIAL POTENTIAL

I am aware that these additive constituents are well known and recognized chemical compounds which have uses in other technologies, but I am not aware of any use or suggestion of use of these active constituents to remove sulfur or to improve the efficiency of any combustion process. I have, however, established the industrial potential for greatly reducing sulfur content in combustion gases and improving the efficiency of caol and of hydrocarbon fuels. I claim as my invention the use of these compounds for that purpose, all as more particularly set forth in the appended claims.

What is claimed is:

1. The method of improving combustion efficiency and reducing sulfur combustion emissions from burning of coal comprising burning coal in the presence of small amounts of squalane, squalene, or a carotenoid, or mixtures thereof.

2. The composition comprising coal intermixed with small amounts, in the parts per million range, of squalane, squalene or carotene, or mixtures thereof.

3. A liquid hydrocarbon fuel having intermixed therein small amounts, in the parts per million range, of carotene.

4. A solid carbonaceous fuel comprising an intermixture of coal and small amounts, in the parts per million range, of squalene, squalane or carotene.

5. The method of improving the efficiency of a diesel operated internal combustion engine comprising intermixing with diesel fuel small amounts, in the parts per million range, of a carotenoid and operating the engine on the resulting fuel.

6. The method of improving energy output and reducing the sulfur in gaseous combustion gases resulting from coal burning comprising adding to such coal before burning an effective amount of up to 5,000 parts per million of squalane, squalene, or a carotenoid, or mixtures of the same.

7. The method of concentrating sulfur in coal ash during combustion of coal comprising burning such coal in the presence of squalane, squalene or carotenoid or mixtures of the same.

* * * * *